US009762990B2

(12) United States Patent
Sapiejewski et al.

(10) Patent No.: US 9,762,990 B2
(45) **Date of Patent: *Sep. 12, 2017**

(54) HEADSET PORTING

(71) Applicants: Roman Sapiejewski, Boston, MA (US); Robert Belanger, Franklin, MA (US); Tristan Edward Taylor, Boston, MA (US)

(72) Inventors: Roman Sapiejewski, Boston, MA (US); Robert Belanger, Franklin, MA (US); Tristan Edward Taylor, Boston, MA (US)

(73) Assignee: Bose Corporation, Framingham, MA (US)

( * ) Notice: Subject to any disclaimer, the term of this patent is extended or adjusted under 35 U.S.C. 154(b) by 273 days.

This patent is subject to a terminal disclaimer.

(21) Appl. No.: 13/851,035

(22) Filed: Mar. 26, 2013

(65) Prior Publication Data

US 2014/0294223 A1 Oct. 2, 2014

(51) Int. Cl.

| | |
|---|---|
| ***H04R 1/10*** | (2006.01) |
| ***G10K 11/178*** | (2006.01) |
| *H04R 1/28* | (2006.01) |

(52) U.S. Cl.

CPC ..... *H04R 1/1058* (2013.01); *G10K 11/178* (2013.01); *H04R 1/1008* (2013.01); *H04R 1/2811* (2013.01); *G10K 2210/1081* (2013.01); *G10K 2210/3214* (2013.01); *G10K 2210/3219* (2013.01); *H04R 1/1083* (2013.01);

(Continued)

(58) Field of Classification Search

CPC ..... H04R 1/10; H04R 1/1008; H04R 1/1058; H04R 1/1066; H04R 1/1083; H04R 1/2811; H04R 1/2826; H04R 1/2823; H04R 1/2846; H04R 2460/01; H04R 2201/105; G10K 11/16; G10K 11/162; G10K 11/172; G10K 11/175; G10K 11/178; G10K 11/18;

(Continued)

(56) References Cited

U.S. PATENT DOCUMENTS

| | | | | |
|---|---|---|---|---|
| 4,160,135 A * | 7/1979 | Gorike | ..... | 381/373 |
| 4,644,581 A * | 2/1987 | Sapiejewski | ..... | H04R 1/1083 381/372 |

(Continued)

FOREIGN PATENT DOCUMENTS

| | | |
|---|---|---|
| EP | 0 232 096 | 8/1987 |
| EP | 1 931 170 | 6/2008 |

(Continued)

OTHER PUBLICATIONS

International Preliminary Report on Patentability; PCT/US2014/030256; M. Mineko; Sep. 29, 2015; 10 pp.

(Continued)

*Primary Examiner* — Davetta W Goins
*Assistant Examiner* — Oyesola C Ojo
(74) *Attorney, Agent, or Firm* — Fish & Richardson P.C.

(57) ABSTRACT

A headset cup having a front cavity and a rear cavity separated by a driver, with a mass port tube connected to the rear port to present a reactive acoustic impedance to the rear cavity, in parallel with a resistive port, the total acoustic response of the rear cavity remaining linear at high power levels. In some embodiments, the mass port tube is made of metal, while the headset cup is otherwise made of plastic.

20 Claims, 4 Drawing Sheets

(52) U.S. Cl.
CPC ..... *H04R 1/2823* (2013.01); *H04R 1/2826* (2013.01); *H04R 1/2846* (2013.01); *H04R 2201/105* (2013.01); *H04R 2460/01* (2013.01)

(58) Field of Classification Search
CPC ..... G10K 11/36; G10K 2210/1081; G10K 2210/3214; G10K 2210/3219
USPC ..... 381/372, 371, 384, 370, 380
See application file for complete search history.

(56) References Cited

U.S. PATENT DOCUMENTS 5,181,252 A * 1/1993 Sapiejewski ..... G10K 11/1788 181/166
5,406,037 A * 4/1995 Nageno ..... H04R 5/0335 181/129
6,597,792 B1 * 7/2003 Sapiejewski ..... H04R 1/1083 381/371
6,735,316 B1 * 5/2004 Wurtz ..... G10K 11/1784 381/317
6,748,087 B1 * 6/2004 Jones ..... G10K 11/1788 381/371
6,831,984 B2 * 12/2004 Sapiejewski ..... H04R 1/2819 181/182
7,466,838 B1 * 12/2008 Moseley ..... G10K 11/1788 381/370
8,588,453 B1 * 11/2013 Lee ..... H04R 1/1008 381/370
8,976,994 B2 * 3/2015 Howes et al. ..... 381/380
2002/0015501 A1 * 2/2002 Sapiejewski ..... H04R 1/1083 381/71.6
2005/0105718 A1 * 5/2005 Hansen ..... H04B 1/64 379/390.01
2006/0269090 A1 * 11/2006 Sapiejewski ..... H04R 1/1083 381/371
2008/0002835 A1 * 1/2008 Sapiejewski ..... H04R 1/288 381/71.6
2009/0028348 A1 * 1/2009 Sokolich ..... H04R 1/1091 381/59
2009/0147981 A1 * 6/2009 Blanchard ..... H04R 1/1075 381/380
2011/0058704 A1 * 3/2011 Harlow ..... H04R 1/1016 381/380
2013/0343593 A1 * 12/2013 Howes et al. ..... 381/380
2014/0068944 A1 * 3/2014 Aase ..... H04R 31/006 29/896.2
2014/0169584 A1 * 6/2014 Narayan ..... H04R 1/1083 381/74
2014/0241562 A1 * 8/2014 Monahan ..... H04R 1/1016 381/380
2014/0270228 A1 * 9/2014 Oishi ..... H04R 1/10 381/74

FOREIGN PATENT DOCUMENTS

EP 2 677 767 12/2013
JP 04227396 A * 8/1992 ..... H04R 1/10

OTHER PUBLICATIONS

International Search Report and Written Opinion mailed Jul. 30, 2014 in international application No. PCT/US2014/030256, 13 pgs.

* cited by examiner

HEADSET PORTING

The present invention relates in general to headset porting and more particularly concerns headsets with linearized ports characterized by an acoustic impedance with a very low resistive component.

BACKGROUND OF THE INVENTION

For background reference is made to U.S. Pat. Nos. 4,644,581, 5,181,252, and 6,831,984, incorporated herein by reference, including their file histories.

SUMMARY OF THE INVENTION

According to the invention the headset cup has a straight smooth port free of projections which introduce perturbations that could cause turbulence preferably made of metal, such as stainless steel, characterized by a linear acoustic impedance with low resistive component at high sound levels, such as those encountered in military applications that are above 120 dB SPL at between 60 and 100 Hz. By increasing the cross section of the port compared to one of small internal diameter , the resistive component is decreased. To keep the overall reactive+resistive impedance the same, the port is lengthened. An exemplary length is 37 mm for a cross section of 9.1 $mm^2$. This construction also extends the range of sound levels over which the port acoustic impedance is effectively linear and maintains the same acoustic performance to 200 Hz. Linearizing the port in this manner allows noise reduction at higher sound levels. The headset cup preferably includes the high compliance driver disclosed in the aforesaid U.S. Pat. No. 5,181,252 in the active noise reducing system thus disclosed.

Other features, objects and advantages will become apparent from the following description when read in connection with the accompanying drawing in which:

DETAILED DESCRIPTION

Figure 1:
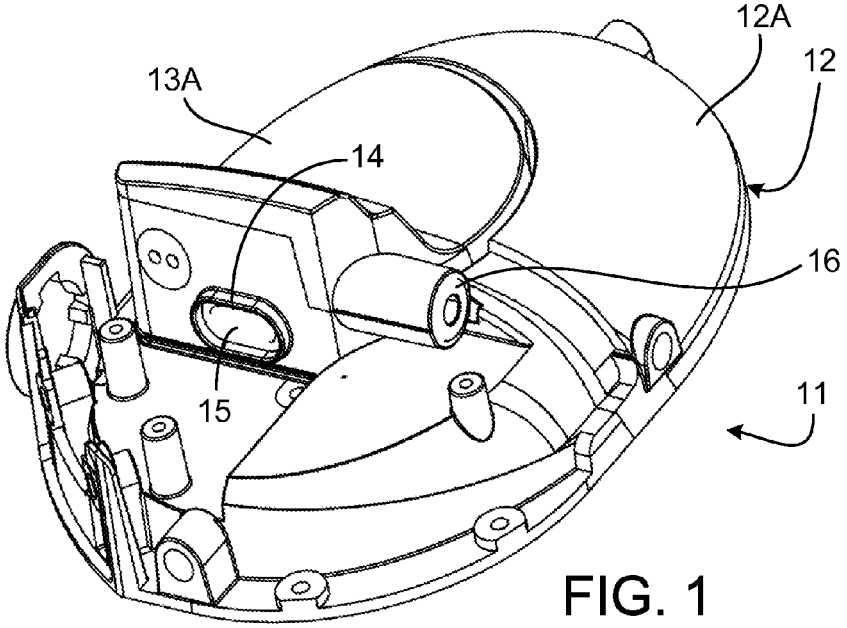
FIG. 1 is a perspective view of a headphone cup incorporating the invention.
Figure 2:
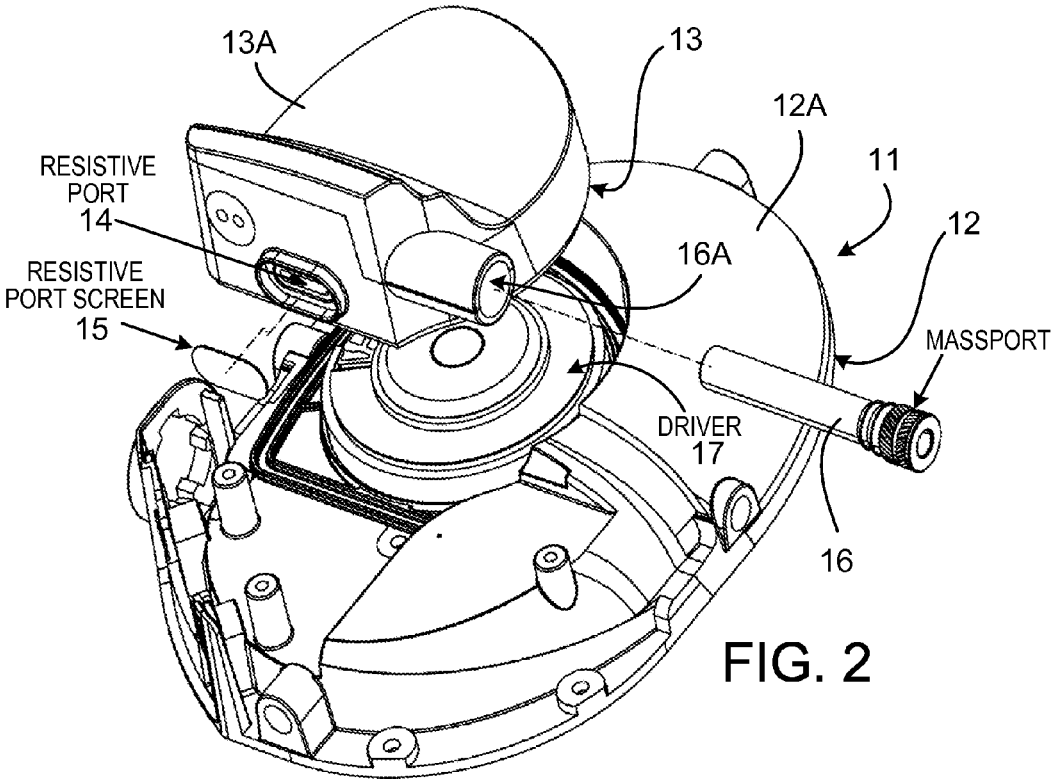
FIG. 2 is a partially exploded view of the headphone cup of FIG. 1 showing the relationship of the metal port to the headphone cup.

With reference now to the drawing and more particularly FIGS. 1 and 2 thereof, there is shown a perspective view of a headset cup embodying the invention. To avoid obscuring the principles of the invention, most conventional components of the headset, including portions of the cup, are not described in detail. Headset cup 11 includes a front cavity 12 partially enclosed by a shell 12A and a rear cavity 13 partially enclosed by a second shell 13A. The two cavities are separated by an electroacoustic transducer, or driver, 17. The front cavity couples sound output by the driver to the user's ear. Air enclosed by the rear cavity presents a controlled acoustic impedance to motion of the driver, controlling the response of the driver and the acoustic performance of the headset. Rear cavity 13 is coupled to the air around it by a resistive port 14 having a resistive port screen 15 and a mass port tube 16.

Both ports present an impedance to air flow that has a resistive and a reactive component. The resistive port 14 is of negligible length, so that the impedance of the port is dominated by the resistance of the port screen. The mass port 16 is significantly longer than it is wide, such that its impedance is dominated by its reactance, which depends on the acoustic mass of the volume of air inside the tube. The impedance of the mass port 16 varies with the frequency of the sound pressure in the rear cavity 13 that is causing air flow through them. In particular, as frequencies decrease, the contribution to total impedance from the reactive component of the mass port decreases, allowing the impedance to be dominated by the resistive component of the mass port's impedance at lower frequencies, which is relatively constant with frequency. The resistive component, however, varies with the sound pressure level inside the cavity, and this variable impedance results in the response being non-linear with pressure at frequencies where the resistive component dominates.

Figure 7:
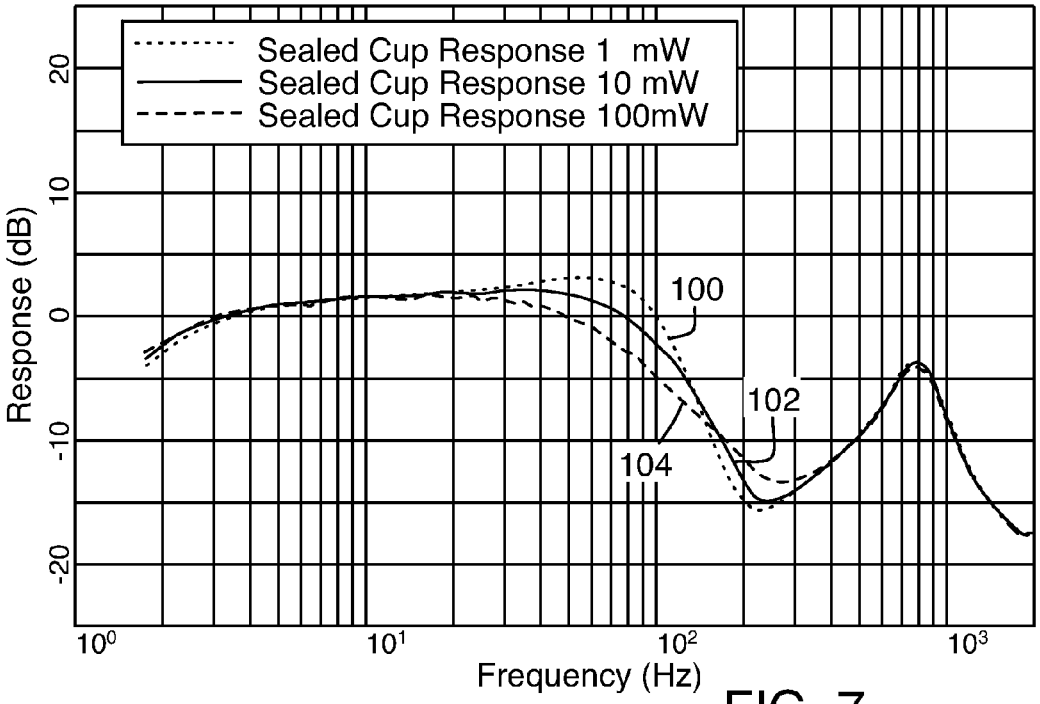
FIGS. 7 and 8 are graphs of headphone cup response to various power level inputs.

Non-linearity, i.e., impedance increasing with sound pressure levels, in the response of the acoustic system limits the output levels at which an ANR circuit can be operated—higher impedance requires more force to move the air, which requires more current through the motor of the transducer, potentially exceeding the capacity of the transducer or amplifier. FIG. 7 shows the normalized response of an ear cup using conventional ports to various input power levels, but with the resistive port (corresponding to 14 in FIG. 1) blocked, so only the mass port is operative. A first, dotted, line 100 shows the response when 1 mW of power is applied. As power is increased to 10 mW, in solid line 102, and 100 mW, in dashed line 104, it can be seen that the response between about 30 Hz and 150 Hz decreases with increasing power. In the particular headphone tested, with the front cavity sealed against a flat plate (not a human ear) these power levels delivered 122 to 137 dB SPL output levels at 60 Hz. Actual power delivered by the complete product would be significantly lower, as these tests were made without any compression used (as discussed below) to avoid overloading the driver. To achieve higher SPL levels in this frequency range, significantly more power would be needed. To avoid overloading the transducer, however, the maximum output power of the ANR circuit is limited, e.g., through compression or clipping, limiting the level of sound that the ANR circuit can cancel. In conventional ANR headsets, the non-linearity is not of significance at the pressure levels experienced in normal operation, so the limiting of output power will not be noticed by most users. Headsets for military applications, however, may be subjected to significantly higher sound pressure levels, at which point the non-linearity of the port response becomes a problem. Prior military ANR headsets have been limited to cancelling sound pressure levels of about 120 dB SPL to avoid compressing the signal.

Figure 8:
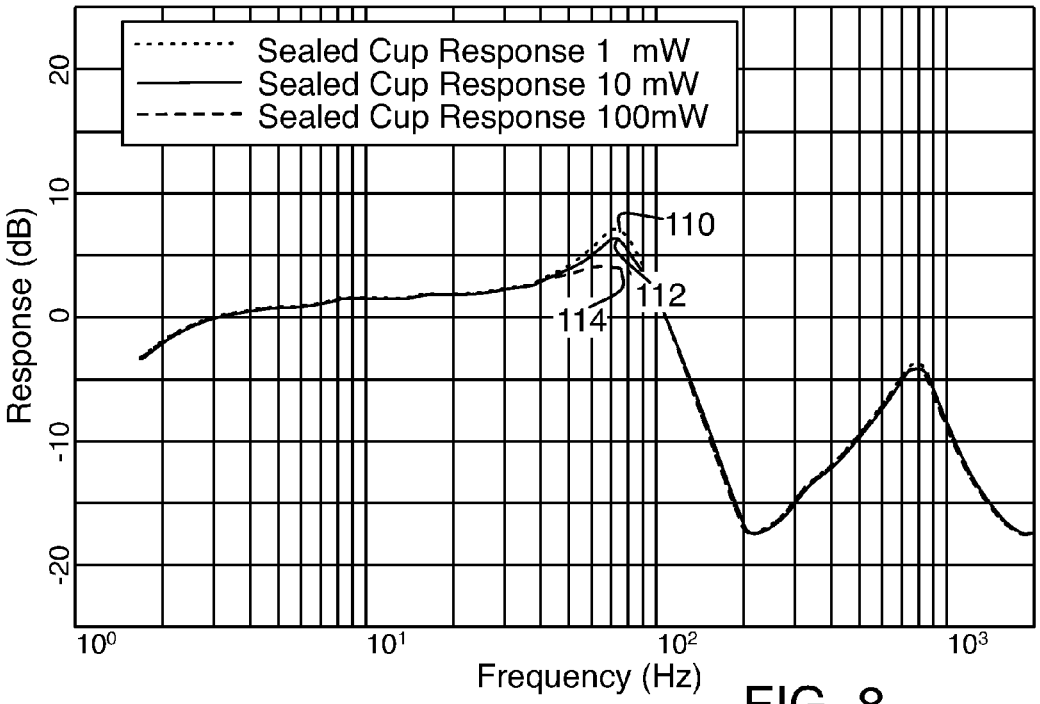

To address this problem, according to the present invention, the mass port is modified, relative to prior designs, to decrease the resistive component of its impedance, extending the frequency range in which the reactive portion dominates and in which the total impedance as a function of frequency is essentially linear. The resistance is decreased by increasing the diameter of the mass port 16. Increasing the diameter alone decreases the effective acoustic mass of the port, so to maintain the original reactance, the length of the mass port is also increased. Increasing the length has more effect on the acoustic mass than it does on the resistance, so this does not undermine the benefits of increasing the diameter. In one example, the cross-sectional area of the port tube is increased from 2.25 $mm^2$ in conventional headsets to 9.1 $mm^2$. To maintain the reactance, the length is increased from 10 mm to 37 mm (end-effects result in the effective length being slightly longer, an effect which increases with diameter). That is, a 4× increase in area is matched by a 4× increase in length. FIG. 8 shows the response, in the same test as FIG. 7, with the enlarged mass port. Dotted line 110 shows the response to 1 mW of power, solid line 112 shows the response to 10 mW, and dashed line 114 shows the response to 100 mW. As can be seen, the response is much more linear—less variation with power levels—across the frequency range, only falling off with power by a small amount, and in a narrower range of 50 to 90 Hz. These normalized curves correspond to an SPL range of 125 dB to 143 dB at the 70 Hz peak. In a real application (resistive port open, leaky seal of front cavity to human head), the ANR circuit of the headset can operate effectively at sound pressure levels as high as 135 dB SPL at frequencies between around 60 to 100 Hz. In contrast, a prior art design embodied in the Bose® TriPort® Tactical Headset would clip the ANR output at sound pressure levels well below 120 dB SPL in the same frequency range to avoid overloading the circuit. Increasing the port dimensions also improves the consistency of the acoustic response across the audible frequency range.

The resistive port 14 in parallel to the mass port 16 also provides a resistive impedance, and it is desirable that the two impedances, resistive and reactive, remain parallel, rather than in series. The purely resistive port improves performance at some frequencies (where a back cavity with only a purely reactive port would have port resonance, significantly cutting output power), while compromising performance at others. Providing this resistance in a controlled, purely resistive port while the reactive port has as little resistance as possible allows that compromise to be managed and its benefits realized to the best advantage of the total system.

Thus, the performance of a headset for use in high-noise environments is improved by extending the operating frequency range at which the acoustic impedance of a mass port from the back cavity to ambient as a function of frequency is purely reactive, such that the total back cavity response remains effectively linear with respect to sound pressure levels. This is accomplished by increasing both the diameter and length of the port, but actually manufacturing such a port presents additional difficulty. As noted, the port in the example is 37 mm long, and has a cross-sectional area of 9.1 $mm^2$, or a diameter of 3.4 mm, for a roughly 10× aspect ratio of length to diameter. Another way to consider the size of the mass port is that the volume of air inside the tube is 337 $mm^3$, while the volume of the rear cavity (not including the volume occupied by the tube itself) is 11,100 $mm^3$, giving a ratio of rear cavity volume to mass port volume of about 33:1. A conventional mass port would have a significantly smaller volume, and thus a significantly larger ratio of rear cavity volume to mass port volume. For example, for the conventional mass port described above with an area of 2.25 $mm^2$ and a length of 10 mm, the volume is 22.5 $mm^3$, and the ratio, in the same size rear cavity, is 493:1. Applying a ten percent tolerance to port volume and cavity volume, the ratio of the present design may vary from around 27:1 to 40:1, while the ratio using the prior port size may vary from around 400:1 to 600:1. The applicant has also found that it is preferable for the port to be of uniform cross-section, to provide consistency in response from unit to unit. It is also preferable for the port to be smooth inside, to avoid causing turbulence, which could reintroduce a resistive component to the response. Providing a long, skinny tube of uniform cross-section and free of internal projections can be prohibitively difficult in the ABS plastic conventionally used for forming the shells 12A and 13A of the headset. Molding a tube with such a long draw could not be done with uniform cross section, and assembling a port from multiple pieces would introduce rough edges, as well as potential assembly variation.

To resolve this, in the embodiment shown in FIGS. 1-5, the mass port 16 is made of metal, such as stainless steel, and has a bore of uniform cross section throughout its length, preserving the reactive nature of the port response. Additionally, the metal port provides a smooth inside surface free of projections that would introduce turbulence, so keeping the resistive component of the port response low. In addition to delivering the desired port response, the metal mass port provides additional advantages. The high mass of the port tube itself prevents ringing of the tube structure (as opposed to the acoustic volume within the tube). For assembly, one end of the tube is formed with a rough surface such as knurling (FIGS. 2 and 4), allowing the metal tube to be heat staked into the ABS plastic of the outer shell 13A, providing a secure and reliable connection between the parts. The portion of the tube extending into the rear cavity may be kept smooth, to ease insertion and to avoid introducing turbulence inside the rear cavity. As can be seen in several of the figures, the tube 16 extends outside of the cavity 13 enclosed by the rear shell 13A. This decreases the amount by which the tube structure itself occupies the volume of the rear cavity, taking away volume available for air. In particular, the portion of the tube that is textured and secured to the plastic extends outside of the rear cavity.

The exploded view of FIG. 2 shows mass port tube 16 removed from the opening 16A that houses it in the back shell 13A. The back cavity shell 13A is also removed from the front shell 12A to reveal the driver 17.

Figure 3:
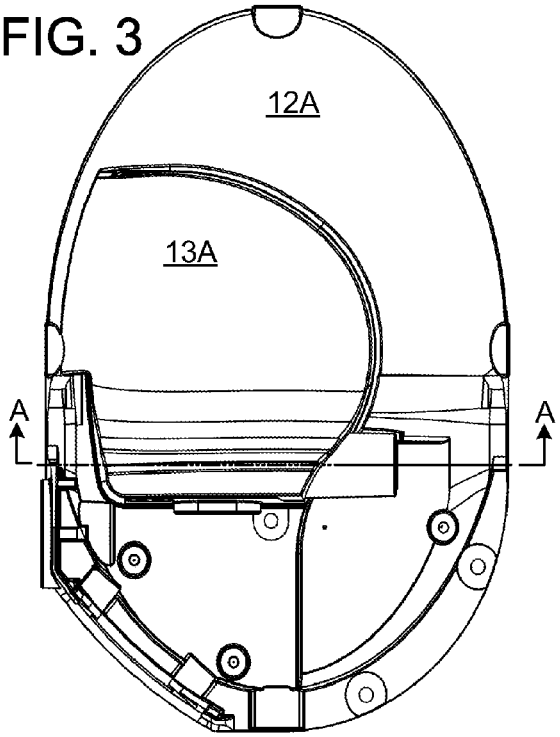
FIG. 3 is a plan view of the headphone cup of FIG. 1.

Referring to FIG. 3, there is shown a plan view of the headset cup of FIG. 1.

Figure 4:
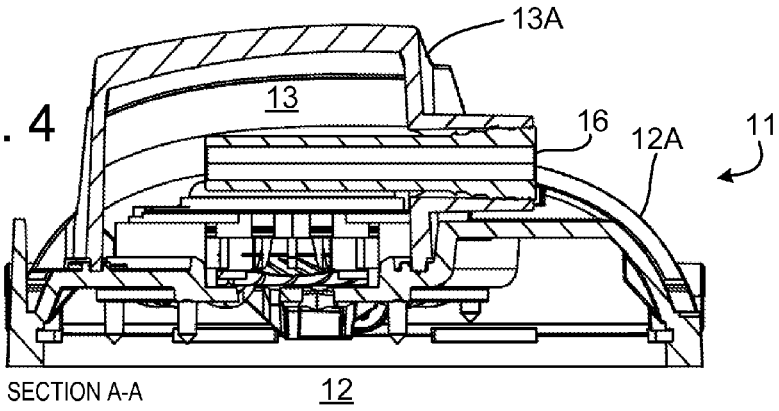
FIG. 4 is a sectional view of the headphone cup of FIG. 1 through section A-A of FIG. 4.

Referring to FIG. 4, there is shown a sectional view through section A-A of FIG. 3 showing the relationship of mass port tube 16 to rear cavity 13.

Figure 5:
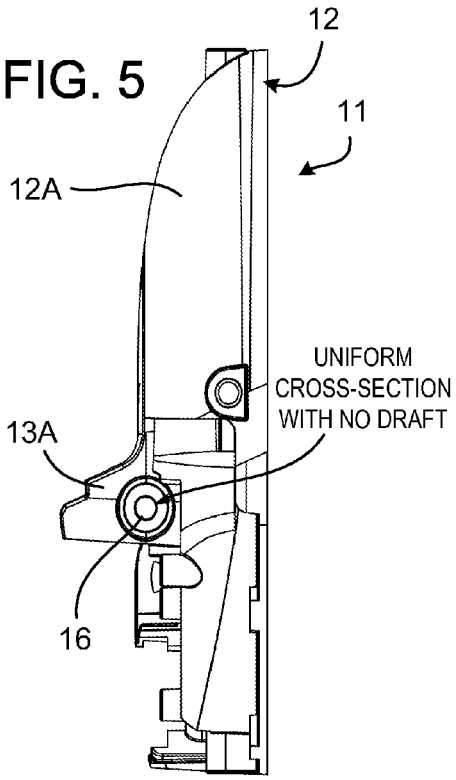
FIG. 5 is a side view of the headphone cup of FIG. 3.

Referring to FIG. 5, there is shown a side view of the headset cup of FIG. 1.

The headset cup of FIG. 1 typically comprises an active noise reducing headset incorporating circuitry of the type described in the aforesaid U.S. Pat. No. 6,831,984 and other patents described therein.

Figure 6:
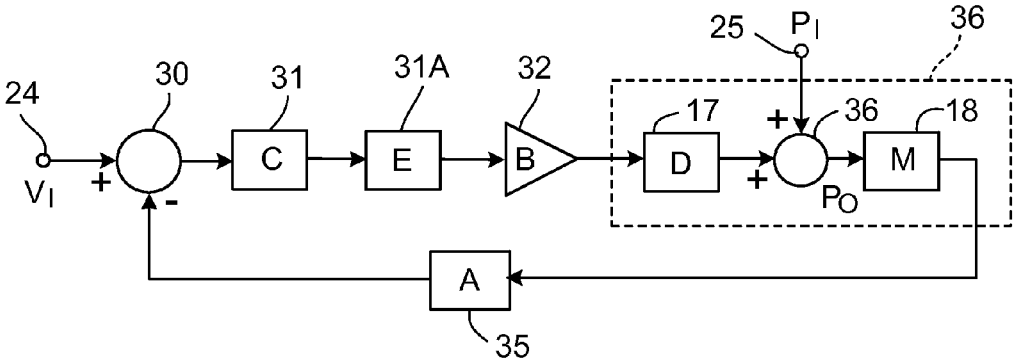
FIG. 6 is a block diagram illustrating the logical arrangement of an active noise reduction system embodying the invention.

Referring to FIG. 6, there is shown a block diagram illustrating the logical arrangement of a system incorporating the invention corresponding substantially to FIG. 1 of the aforesaid '581 patent and FIG. 4 of the aforesaid '252 patent. A signal combiner 30 algebraically combines the signal desired to be reproduced by the headphones, if any, on input terminal 24 with a feedback signal provided by microphone preamplifier 35. Signal combiner 30 provides the combined signal to compressor 31 which limits the level of the high level signals. The output of compressor 31 is applied to compensator 31A. Compensator 31A includes compensation circuits to insure that the open loop gain meets the Nyquist stability criteria, so that the system will not oscillate when the loop is closed. The system shown is duplicated once each for the left and right ears.

Power amplifier 32 amplifies the signal from compensator 31A and energizes headphone driver 17 to provide an acoustical signal in cavity 12 that is combined with an outside noise signal that enters cavity 12 from a region represented as acoustical input terminal 25 to produce a combined acoustic pressure signal in cavity 12 represented as a circle 36 to provide a combined acoustic pressure signal applied to and transduced by microphone 18. Microphone amplifier 35 amplifies the transduced signal and delivers it to signal combiner 30.

There has been described a ported headset characterized by a port having a linear acoustic impedance at high sound levels to allow improved noise reduction in a very noisy environment where the sound level may be greater than 120 dB SPL between 60 and 100 Hz. It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirited scope of the appended claims.

What is claimed is:

1. An around-the-ear headset cup comprising:

a front cavity;

a rear cavity;

a driver disposed between the front cavity and the rear cavity, the driver configured to radiate sound pressure levels larger than 120 dB; and a mass port and a resistive port connected to the rear cavity such that corresponding acoustic impedances due to the two ports are in parallel, the mass port having a cross-sectional area larger than 2 $mm^2$, and a length configured in accordance with a target effective acoustic mass of the mass port for the cross-sectional area, such that the mass port has a principally reactive acoustic impedance, and corresponding frequency responses of the rear cavity at driver-generated sound pressure levels larger than 120 dB are substantially invariant, wherein the mass port comprises a mass port tube that encloses an interior volume that is at least 1/40 the volume of the rear cavity, the volume of the rear cavity excluding the volume occupied by the mass port tube.

2. The around-the-ear headset cup in accordance with claim 1, wherein the driver-generated sound pressure levels comprise sound pressure levels larger than 135 dB SPL.

3. The around-the-ear headset cup in accordance with claim 1 wherein the mass port comprises a tube of length substantially equal to 37 mm.

4. The around-the-ear headset cup in accordance with claim 1 wherein the mass port comprises a tube having a cross-sectional area substantially equal to 9 $mm^2$.

5. The around-the-ear headset cup in accordance with claim 1 wherein the mass port comprises a tube having a length-to-inside diameter aspect ratio substantially equal to 10:1.

6. The around-the-ear headset cup in accordance with claim 1 wherein the mass port comprises a tube made of metal.

7. The around-the-ear headset cup in accordance with claim 6 wherein said metal comprises stainless steel.

8. The around-the-ear headset cup in accordance with claim 1 and wherein the resistive port includes a resistive screen.

9. The around-the-ear headset cup in accordance with claim 1 wherein the mass port comprises a tube that extends outside the rear cavity.

10. The around-the-ear headset cup in accordance with claim 9 wherein the mass port tube comprises a metal tube seated inside a wall of the rear cavity.

11. The around-the-ear headset cup in accordance with claim 1 wherein the cup is made of plastic, and the mass port comprises a tube that extends outside the rear cavity.

12. The around-the-ear headset cup in accordance with claim 1, further comprising an active noise reduction circuit coupled to the driver.

13. A headset comprising, at least one around-the-ear cup having a front cavity and rear cavity with front cavity and rear cavity compliances respectively;

a driver configured to radiate sound pressure levels larger than 120 dB, the driver disposed between said front and rear cavities, and having a compliance that is larger than said rear cavity compliance, said ear cup comprising a mass port and a resistive port connected to the rear cavity such that the acoustic impedances due to the two ports are in parallel, said mass port having a cross-sectional area larger than 2 $mm^2$, and a length configured in accordance with a target effective acoustic mass of the mass port for the cross-sectional area, such that the mass port has a principally reactive acoustic impedance, and corresponding frequency responses of the rear cavity at driver-generated sound pressure levels larger than 120 dB are substantially invariant, wherein the mass port comprises a tube having a length-to-inside diameter aspect ratio substantially equal to 10:1; and and an active noise reduction system coupled to said driver.

14. The headset in accordance with claim 13 wherein the mass port comprises a tube of length substantially equal to 37 mm.

15. The headset in accordance with claim 13 wherein the mass port comprises a tube having a cross-sectional area substantially equal to 9 $mm^2$.

16. An apparatus comprising:

a first around-the-ear cup shell of a headphone;

a second around-the-ear cup shell of the headphone;

an electroacoustic driver configured to radiate sound pressure levels larger than 120 dB, the electroacoustic driver disposed between the first and second around-the-ear cup shells, such that the first around-the-ear cup shell and a first face of the driver define a front cavity, and the second around-the-ear cup shell and a second face of the driver define a rear cavity; and a metal tube at least 35 mm in length and having an internal bore with cross sectional area of at least 9 $mm^2$, the metal tube seated in the second ear cup shell and coupling the rear cavity to space around the apparatus, wherein the second around-the-ear cup shell comprises plastic, and the metal tube comprises a rough exterior surface at one end, the rough exterior surface being anchored in the plastic of the second around-the-ear cup shell.

17. The apparatus in accordance with claim 16, wherein the rough exterior surface of the metal tube and the plastic of the second ear cup shell to which it is anchored are outside of the rear cavity, and the portion of the metal tube inside the rear cavity is substantially smooth.

18. The apparatus in accordance with claim 16, wherein the internal bore of the tube is substantially uniform in cross-section.

19. The apparatus in accordance with claim 16, wherein the internal bore of the tube is substantially smooth.

20. The apparatus in accordance with claim 16, wherein the metal tube is made of stainless steel.

* * * * *